US012215553B2

(12) United States Patent
Dagert et al.

(10) Patent No.: US 12,215,553 B2
(45) Date of Patent: Feb. 4, 2025

(54) PORTABLE DOWNFORCE SYSTEM AND METHOD

(71) Applicant: Treeline Well Services LP, Calgary (CA)

(72) Inventors: Matt Dagert, Calgary (CA); Colin Knapp, Okotoks (CA)

(73) Assignee: Treeline Well Services LP, Calgary (CA)

( * ) Notice: Subject to any disclaimer, the term of this patent is extended or adjusted under 35 U.S.C. 154(b) by 85 days.

(21) Appl. No.: 17/973,094

(22) Filed: Oct. 25, 2022

(65) Prior Publication Data

US 2024/0133253 A1 Apr. 25, 2024
US 2024/0229579 A9 Jul. 11, 2024

(51) Int. Cl.
*E21B 19/086* (2006.01)
*E21B 3/04* (2006.01)
*E21B 19/07* (2006.01)

(52) U.S. Cl.
CPC ..... *E21B 19/086* (2013.01); *E21B 3/045* (2013.01); *E21B 19/07* (2013.01)

(58) Field of Classification Search
CPC ..... E21B 19/086; E21B 19/07; E21B 3/045
See application file for complete search history.

(56) References Cited

U.S. PATENT DOCUMENTS 4,290,495 A 9/1981 Elliston
5,433,279 A * 7/1995 Tessari ..... E21B 19/16 173/147
7,117,948 B2 10/2006 Mazzella et al.
8,793,960 B1 * 8/2014 Burns ..... E21B 15/003 166/85.1
9,238,947 B2 10/2016 Kallal
2005/0161225 A1 * 7/2005 Cole ..... E21B 17/026 166/85.5
2010/0080670 A1 * 4/2010 Henderson ..... E21B 19/06 414/22.68
2010/0230115 A1 * 9/2010 Belik ..... E21B 19/089 166/380
2015/0259984 A1 * 9/2015 Taggart ..... E21B 7/023 175/57
2018/0274307 A1 * 9/2018 Stewart ..... E21B 19/143
2018/0313165 A1 11/2018 Gillibrand et al.
2018/0328112 A1 * 11/2018 Berry ..... E21B 19/20

OTHER PUBLICATIONS

Canadian Patent Application No. 3180303 Office Action dated Jan. 12, 2023.

* cited by examiner

*Primary Examiner* — Shane Bomar
(74) *Attorney, Agent, or Firm* — Boyle Fredrickson, S.C.; Kirk L. Deheck

(57) ABSTRACT

A wellbore tubular handling system for applying a downforce to wellbore tubulars using a service rig. A downforce system includes a first frame assembly coupled to a slip assembly for engaging wellbore tubulars, a base member connected to the first frame assembly, and an actuator adapted to extend and/or retract the first frame assembly between a first position and a second position, wherein the second position is laterally displaced from the first position along a path formed by extension of the actuator, and wherein the base member is connected to the mast of the service rig. A method of applying a downforce to a wellbore tubular using a downforce system for a service rig.

13 Claims, 16 Drawing Sheets

PORTABLE DOWNFORCE SYSTEM AND METHOD

FIELD

The present invention relates to a wellbore tubular handling system and more specifically including systems and methods for forcing tubulars into and out of an oil or gas well using a service rig.

BACKGROUND

This section is intended to introduce various aspects of the art, which may be associated with the present disclosure. This discussion is believed to assist in providing a framework to facilitate a better understanding of particular aspects of the present disclosure. Accordingly, it should be understood that this section should be read in this light, and not necessarily as admissions of prior art.

Snubbing is used in the oil and gas industry for performing well interventions and well completions on wells that are under pressure. A snubbing unit is used to force jointed tubing into and out of a well while maintaining the pressure in the well (i.e. not requiring the well to be killed). Unlike wireline or coiled tubing, which have an outer diameter that remains constant throughout its length, jointed tubing has a varying outer diameter (i.e. the collars where the sections of jointed tubing are connected tend to have a larger outer diameter) requiring the collars to be taken into account when the jointed tubing is forced into or out of a well.

A snubbing unit is typically a relatively tall structure. It must be tall enough to lift a section of jointed tubing above the wellhead to be connected to a section of jointed tubing extending out of the wellhead. It typically also has some hydraulically powered components. A stationary slip and a hydraulically powered traveling slip are also typically provided to force the jointed tubing in and out of the well. The traveling slips are used to grab the pipe section and drive the tubing section into or out of the well. The stationary slips are used to hold the tubing section in place in the well, while the stationary slips release the tubing section and are repositioned for the next stroke.

Snubbing units also typically require pressure control components to maintain the pressure in the well while the tubulars are being snubbed into or out of the well. These components provide sealing to the outside of the tubulars while the jointed tubing is being forcibly inserted into the wellhead and have to accommodate the increased outside diameters at the joints of the tubulars.

Typically, snubbing is often done with standalone structures. The standalone structure must be installed at the wellhead and the snubbing of the tubular string performed. Once the snubbing has been completed, the stand alone snubbing unit can be removed and a service rig brought in to perform completion services on a well. If for any reason more snubbing operations have to be performed before the completion services are finished, the service rig must be removed from the wellhead and the standalone structure put back in place around the wellhead to perform the additional snubbing operations.

An example of a wellbore tubular handling system is provided in U.S. Pat. No. 9,238,947.

However, it remains desirable to provide an improved wellbore handling system.

SUMMARY

It is an object of the present disclosure to obviate or mitigate at least one disadvantage of previous wellbore tubular handling systems.

In a first aspect, the present disclosure provides a portable downforce system including, a first frame assembly coupled to a slip assembly for engaging wellbore tubulars, a base member connected to the first frame assembly, and an actuator configured to extend and/or retract the first frame assembly between a first position and a second position, wherein the second position is laterally displaced from the first position along a path formed by extension of the actuator, and wherein the base member is connected to a mast of a service rig.

In an embodiment disclosed, the first position is a retracted position away from a tubular path into a wellbore and the second position is an extended position aligned with the tubular path into the wellbore.

In an embodiment disclosed, the first frame assembly extends in a generally horizontal direction orthogonal to the wellbore.

In an embodiment disclosed, the slip assembly defines an opening for accepting tubulars up to about 9 inches in diameter with couplings up to about 10 inches in diameter.

In an embodiment disclosed, the actuator is one or more of a linear actuator, a hydraulic cylinder, a jack, a ratchet, a winch, a gravity actuator, a ball/screw system, a cable system and/or a rack and pinion system.

In an embodiment disclosed, the slip assembly is connected to at least two linear actuators connected to the first frame assembly.

In an embodiment disclosed, the linear actuators are hydraulic cylinders.

In an embodiment disclosed, the portable downforce system further includes an intermediate member between the first frame assembly and the base member.

In an embodiment disclosed, the linear actuators comprise a first set of linear actuators for displacing the intermediate member from the base member and a second set of linear actuators for displacing the first frame assembly from the intermediate member.

In an embodiment disclosed, the base member is securable to a mast of the service rig.

In an embodiment disclosed, the base member is securable to a T-bar of a mast frame of the mast.

In an embodiment disclosed, the base member is connected to discrete mounts pinned to the T-bar of the mast frame.

In an embodiment disclosed, the first frame assembly is substantially within the mast frame when in the first position.

In an embodiment disclosed, the base member comprises a winch for adjusting a position of the base member in the mast frame.

In an embodiment disclosed, a power supply separate from the service rig is provided to the portable downforce system.

In an embodiment disclosed, the slip assembly comprises a rotary table.

In an embodiment disclosed, the rotary table is operable in one or more operation mode including freely rotatable, clockwise rotation, anticlockwise rotation, clockwise drive, anticlockwise drive and/or locked.

In an embodiment disclosed, the one or more operation mode is selectively set by a user.

In a further aspect, the present disclosure provides a method for moving wellbore tubulars into or out of a wellhead, the method including, positioning a travelling slip assembly in line with a center of the wellhead, feeding a tubular through the travelling slip assembly; applying a downforce or an upforce using the travelling slip assembly to push the tubular into or pull the tubular out of the wellhead; and retracting the travelling slip assembly so that it is no long in line with the center of the wellhead when not in use.

In an embodiment disclosed, the positioning or the retracting or both comprise lateral movement of the travelling slip assembly.

In an embodiment disclosed, the positioning or the retracting or both consist of lateral movement of the travelling slip assembly.

In an embodiment disclosed, the method further includes installing a portable downforce system comprising the travelling slip assembly to a mast of a service rig before positioning the tubular in line with the center of the wellhead.

In an embodiment disclosed, the method further includes uninstalling the portable downforce system when not in use.

In an embodiment disclosed, the wellhead is associated with a wellbore having a wellbore trajectory, having a string of wellbore tubulars therein, wherein a resistance force resisting movement of the string of wellbore tubulars is substantially equal to or exceeds the force of gravity urging movement of the string of tubulars into the wellbore.

In an embodiment disclosed, the wellbore trajectory comprises a shallow horizontal well, having a relatively shorter substantially vertical section and a relatively longer horizontal or deviated section.

In an embodiment disclosed, the wellhead is associated with a steam assisted gravity drainage (SAGD) well.

In an embodiment disclosed, a pressure at the wellhead has been substantially equalized by a kill fluid such that the pressure is substantially reduced to or is substantially zero.

A portable downforce system is provided. The system may be used to provide temporary well interventions and well completions when required and removed when not in use. Removal of the system when not in use allows the system to be re-used for different well projects, thereby increasing the use of the system over its lifetime. Typically well intervention equipment is permanently placed on a service rig during the life of the project and therefore is subjected to long periods of idleness when not in use. The easy rig up and rig out provided by the portable downforce system according to embodiments of this description allows the system to be used on more projects in a shorter period of time than any conventional methods.

The portable downforce system as disclosed in this description is further configured to provide service to a broader range of wellbore tubulars, including wellbore tubulars greater than the conventionally accepted 7 inch diameter tubulars. The system is therefore suitable for a wide range of wellbore tubulars and can be used on multiple rig projects in a shorter amount of time than equipment that is permanently secured to a service rig, and suitable for only limited sizes of tubulars.

The portable downforce system according to embodiments of this disclosure may be suitable for forcing tubulars into and out of an oil and gas well when connected to a service rig. The well in these instances may be pressurized and therefore requires additional force provided by the downforce system to push the tubulars into (or pull the tubulars out of) the well. The portable downforce system however may also be used for wells that are shallow and/or not pressurized or under low pressure. For example, some wells comprise horizontal portions that may be of significant length such that the force of gravity is insufficient to drive the tubulars into the well, for example due at least in part to friction between tubulars and the wall of the wellbore. The portable downforce system according to embodiments of this description may be used to force tubulars into wellbores include those that are not pressurized but which comprise horizontal portions. In some examples, the portable downforce system may also be used for upforce to bring tubulars out of the wellbore.

Other aspects and features of the present disclosure will become apparent to those ordinarily skilled in the art upon review of the following description of specific embodiments in conjunction with the accompanying figures.

BRIEF DESCRIPTION OF THE FIGURES

Embodiments of the present disclosure will now be described, by way of example only, with reference to the attached Figures.

DETAILED DESCRIPTION

Figure 1:
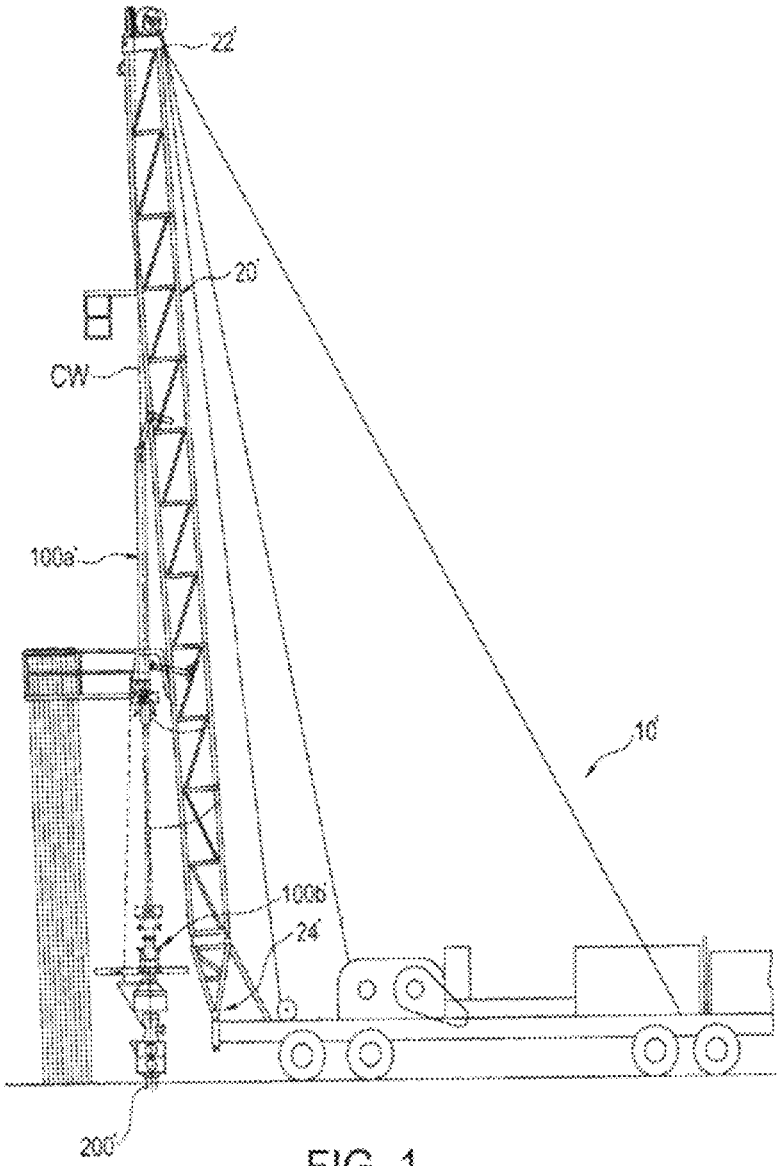
FIG. 1 PRIOR ART
FIG. 1 is a side view of a prior art service rig having a mast and a snubbing device, with the snubbing unit positioned to perform snubbing operations on a well.

For the purpose of promoting an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. It will be apparent to those skilled in the relevant art that some features that are not relevant to the present disclosure may not be shown in the drawings for the sake of clarity.

At the outset, for ease of reference, certain terms used in this application and their meaning as used in this context are set forth below. To the extent a term used herein is not defined below, it should be given the broadest definition persons in the pertinent art have given that term as reflected in at least one printed publication or issued patent. Further, the present processes are not limited by the usage of the terms shown below, as all equivalents, synonyms, new developments and terms or processes that serve the same or a similar purpose are considered to be within the scope of the present disclosure.

As used herein, the following terms have meaning ascribed to them unless specified otherwise.

The terms "rig", "service rig", "completion rig", "workover rig", and "drilling rig" as used herein are used interchangeably to refer to any mast structure extending above and proximate a well for performing a well service. The well service may, for example, include applying a downforce to a tubular for insertion into the wellbore.

Throughout this disclosure, where a range is used, any number between or inclusive of the range is implied.

Generally, the present disclosure provides a system, apparatus and/or method of applying a downforce to a wellbore tubular.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

A service rig can be used for well completion work, such as logging, swabbing, perforating, etc. as well as forcing tubular joints into pressurized wells through the wellhead and other general pipe push and pull processes. A service rig can have an elongate derrick or mast that can be erected over a wellhead when the service rig is positioned at the well site. The mast has a top end and a bottom end with the bottom end typically being pivotally mounted to a bed of a transport chassis of the service rig. The bottom end of the mast can be pivotally connected to a rearmost end of the bed of the service rig. In this manner, the mast can be placed in a transport position where it is pivoted substantially horizontally along the bed of the service rig, allowing the service rig to be transported to a well site. When the service rig is positioned at a well site, the mast can be placed in an erect position by pivoting it upwards away from the bed so that a top end of the mast is positioned substantially over the well head.

Typically, when the mast is positioned in its erect position, the mast is positioned in a slightly over-vertical position so that the top end of the mast can be positioned substantially over the wellhead, while the rear of the bed of the service rig (where the bottom end of the mast is pivotally connected to the bed of the service rig) can be positioned adjacent to the wellhead. In one aspect, the mast can be positioned between about 2 to about 10° from vertical (i.e. from about 90°), sometimes referred to as lean. In this manner, a wellhead center line CW, running from the center of the well to the top end of the mast can be provided with the front side of the mast clearing this center line CW. This allows a number of completion services to be performed on the well without the front side of the mast adversely affecting the performance of these services. For example, the mast is oriented to prevent the front side from blocking tools from operating along CW. However, the mast need not be vertical or near-vertical, and in an embodiment disclosed, the presently disclosed downforce system and apparatus may be used with non-vertical masts, for example mast angles of about 45° slant away from about vertical to about 15° lean past about vertical, or about 40° slant to about 10° lean. The mast angle may be any suitable mast angle. The mast angle may be more than 15° lean. The mast angle may be more than 45° slant.

The service rig can be provided with a basket on the mast, a block including sheaves provided on the top end of the mast, one or more cables roved through the sheaves, a traveling block suspended in the mast on the cables and one or more drums to drive the cables. In addition, a further one or more cables are roved through the block and driven via winches on the rig. These components allow the service rig to provide a number of completion services including the handling of wellbore tubulars.

The mast is typically formed from a number of elongate structural members running along an axis defined by the length of the mast. A number of cross members and cross braces can be connected between the elongate structural members to provide the elongate structural members with structural rigidity.

The transport chassis of the service rig can be any suitable transport chassis. The transport chassis may be, for example, a skid, a trailer pulled behind a tow vehicle, or a vehicle such that the bed may be carried on wheels, tracks, skid rails, etc.

Figure 2:
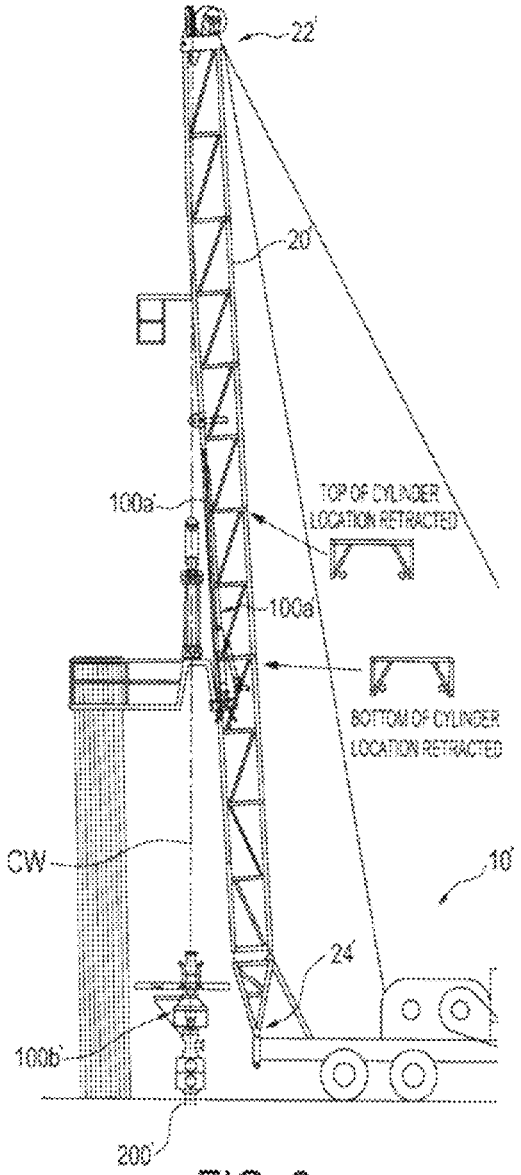
FIG. 2 PRIOR ART
FIG. 2 is a side view of the service rig of FIG. 1 with the snubbing device in a retracted position.
Figure 3:
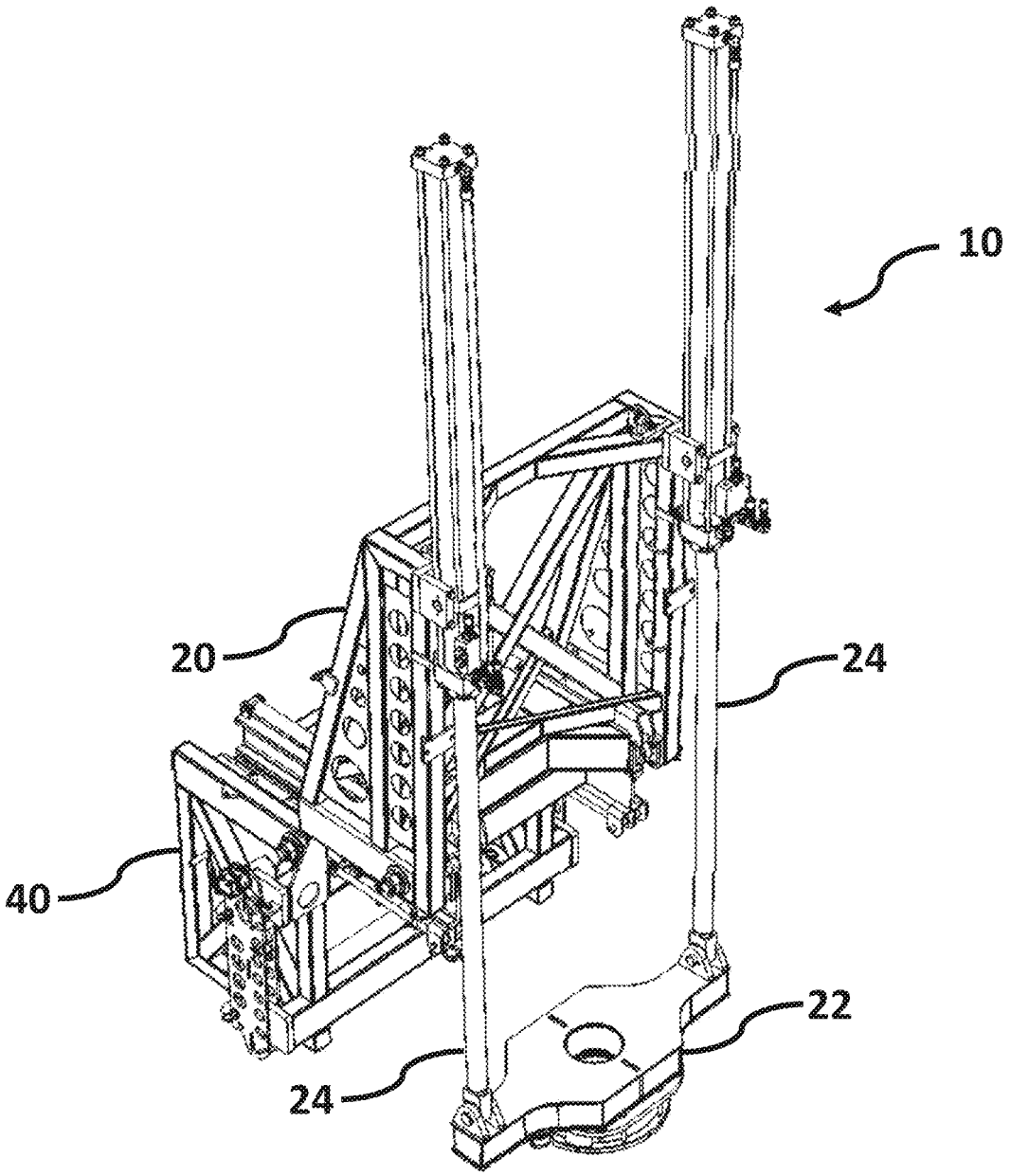
FIG. 3 illustrates a perspective view of a portable downforce system according to embodiments of the present description.

FIG. 1 and FIG. 2 illustrate an example of an existing wellbore tubular handling system of U.S. Pat. No. 9,238,947. This prior art wellbore handling system includes a service rig 10' with a mast 20' and a snubbing apparatus 100*a*', 100*b*' for snubbing jointed tubulars into and out of a wellhead 200' and a well accessed therethrough. A first portion of the snubbing apparatus, upper snubbing unit 100', can be connected to the mast 20' so that it can be swung into an operative position, in place over top of a wellhead 200', substantially in line with the center line CW and used to perform snubbing operations on the well. The upper snubbing unit 100*a*' can also be swung away, out of line with the center line CW of the wellhead 200' into a stored position when other well completion services are being performed on the well by the service rig 10'. The upper snubbing unit 100*a*' can be connected to the mast 20' between the top end 22' of the mast 20' and the bottom end 24' of the mast 20'. FIG. 1 is a side view of the service rig having a mast and a snubbing device, with the snubbing unit positioned to perform snubbing operations on a well, while FIG. 2 shows the same side view of the service rig with the snubbing device in a retracted position.

FIGS. 3 to 7 illustrate different views of a portable downforce system 10 according to embodiments of this invention. Like elements in each of FIGS. 3 to 7 are labeled with the same reference numeral. The downforce system 10 is a modular system configured to be connectable to a mast or derrick of a rig, such as for example a service rig, a drilling rig or other rig for wellbore activities. The downforce system 10 may be temporarily secured to the mast during use, for example the downforce system may be mounted to an existing T-rail or T-bar of the mast, and may be removed when no longer required. The downforce system 10 may be more permanently secured, for example by welding, bolting, or other fastener.

The downforce system 10 comprises a first portion of the system, for example a first or upper frame assembly 20 and a second portion of the system, for example a base member or second or lower frame assembly 40. In an embodiment, the upper frame assembly moves relative to the lower frame assembly by extending a distance laterally from the lower frame assembly, for example, in a substantially horizontal direction from the lower frame assembly. A substantially horizontal direction may be for example a direction that is parallel to the floor, or a direction that forms an angle of less than 10 degrees with a line that is parallel to the floor when the system is in an upright position. In an example where the lower frame assembly is connected to a mast operating at a lean, for example a lean of about 3.0° to about 3.5°, the upper frame assembly may extend in a direction that is perpendicular to the mast and substantially horizontal to the floor taking into account the lean of the mast. The upper frame assembly need not extend/retract in a substantially horizontal direction, and instead may extend/retract in an angular direction. The angular direction may be any suitable angular direction. The angular direction may, for example, be about −45° to about 45°, about −40° to about +40°, about −35° to about +35°, about −25° to about +25°, about −20° to about +20°, about −15° to about +15°, about −10° to about +10°, about −5° to about +5°, about −3° to about +3°. The angular direction may be substantially or about 0° (horizontal). The angular direction may be greater than +/−45°.

The upper frame assembly acts as a carrier and may be configured to hold, carry or otherwise engage with a force slip assembly, for example a travelling force slip assembly 22. The slip assembly is configured to engage with wellbore tubulars (not shown) to move the tubulars into or out of a well when the slip assembly is positioned in line with the centerline of wellhead. The slip assembly may be connected to one or more linear actuators, for example hydraulic cylinders 24, or for example hydraulic rams or pistons, which are engaged by the upper frame assembly. Actuation of the linear actuators moves the slip assembly up or down, towards or away from the floor or well. In another embodiment, any other actuation means connected to the upper frame assembly for moving the slip assembly towards or away from the floor or well in a substantially vertical direction may be used. A substantially vertical direction may be for example a direction that is perpendicular to the floor or a work floor or in other words substantially in the direction of gravity. For example, in an embodiment where the downforce system is installed on a mast also comprising a work floor, for example a work floor that is 10 feet to 20 feet above the ground or even 30 feet or 40 feet above the ground, the downforce system is installed above the work floor and the slip assembly may be actuated towards or away from the work floor in a direction that is perpendicular to the work floor. The slip assembly may be used to transfer force from the system to the wellbore tubulars engaged by the slip assembly, for example, a downforce or an upforce to push or pull the wellbore tubulars into or out of the well. In another example, trunnion mounted cylinders (without guide bars) may be used to ensure vertical movement independent of mast lean angle.

Extension of the upper frame assembly may be used, for example, to align the slip assembly with a well on the ground such that the wellbore tubulars engaged by the slip assembly 22 can be pushed into or pulled out of the well. The upper frame assembly may extend completely or only part of the way depending on the intended use and location of the well. In an example system, the upper frame assembly may preferably extend up to about 24 inches from its starting position. In an example the upper frame assembly may be fully retracted to a position above the lower frame assembly. In another example, when the downforce system is connected to a mast, a fully retracted upper frame assembly may be entirely fit into the mast frame or partially protruding from the mast frame. The lower frame assembly 40 preferably remains stationary and secured to the mast. The lower frame assembly may be entirely fit into the mast frame or may partially protrude from the mast frame. For example the lower frame assembly may partially protrude from the mast frame about 19 inches.

Figure 4:
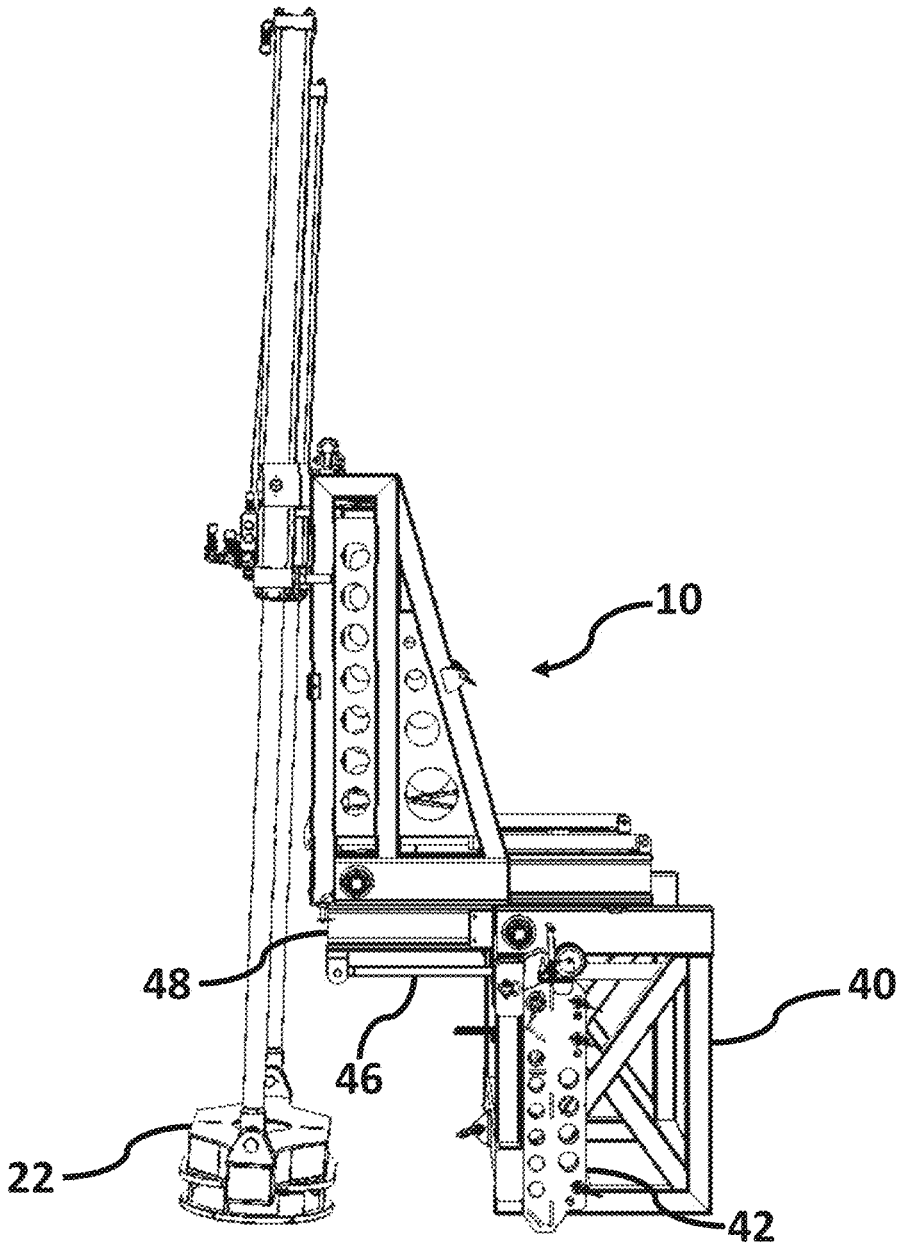
FIG. 4 illustrates a side view of the portable downforce system according to embodiments of the present description.
Figure 5:
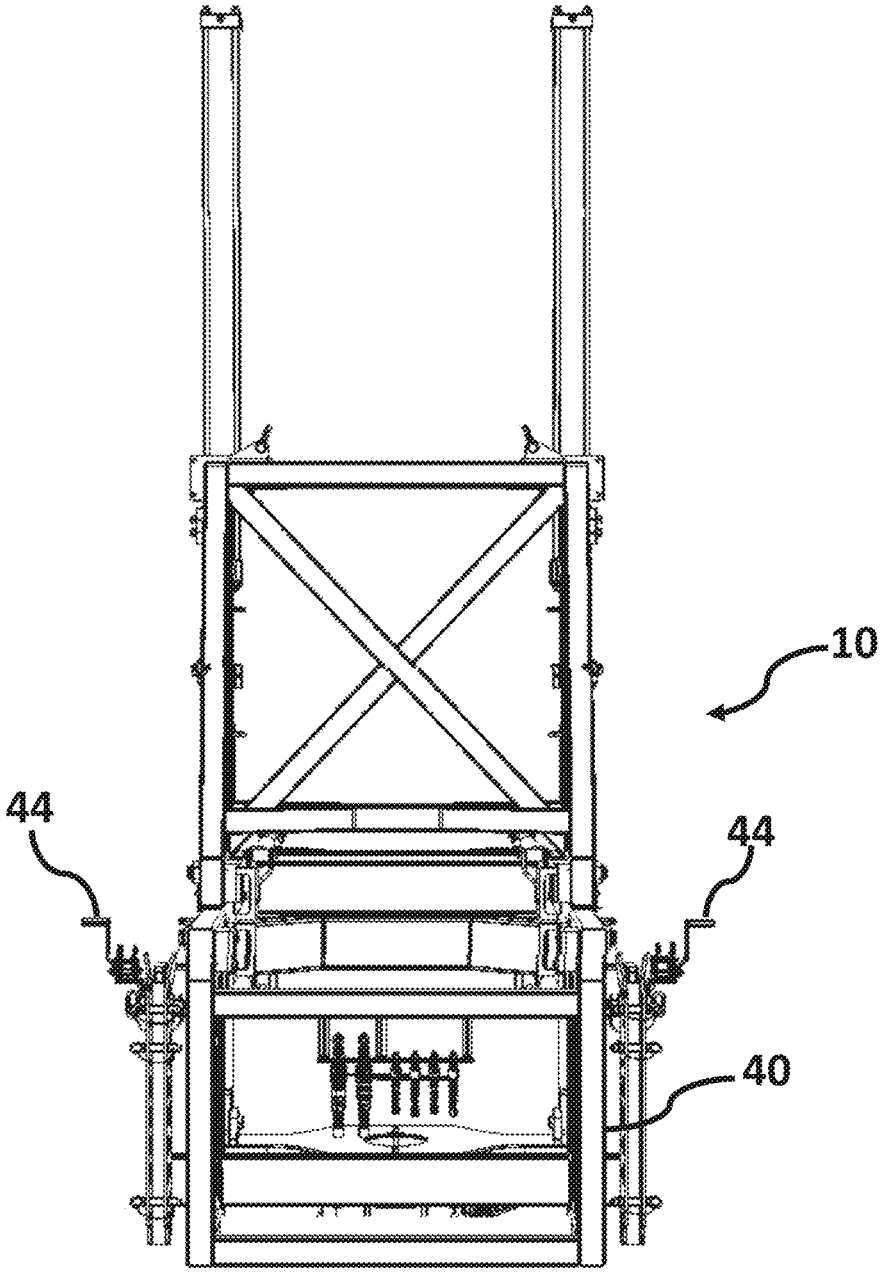
FIG. 5 illustrates a rear view of the portable downforce system according to embodiments of the present description.

FIG. 4 illustrates the upper frame assembly 20 in a retracted position completely within the mast frame 60 and the lower frame assembly 40 stationary and slightly protruding from the mast frame. In the retracted position, the slip assembly 22 is raised such that it is above the lower frame assembly 40. The slip assembly, by virtue of being connected to hydraulic cylinders 24 engaged with the upper frame assembly 20, is also retracted at least partially within the mast frame 60. FIG. 5 illustrates the upper frame assembly 20 in its extended position, the lower frame assembly 40 remains in the same stationary position above and proximate to a work floor 62. In the extended position, the slip assembly 22 is aligned with the well center and hole 64 in the work floor 62.

The lower frame assembly 40 may be secured to a rig mast. The lower frame assembly 40 may comprise mounts 42 for securing the downforce system to the mast. For example two or more mounts 42 may be used to secure the lower frame assembly 40 to the T-bar or T-rail of the mast. In an embodiment for easy installation, the mounts may be first pinned to the mast followed by securing the lower frame assembly to the pinned mounts 42. Lifting lugs and wires may be used to lift the downforce system 10 into position for securing to the mounts 42. Hand winches 44 may be used with each mount to help draw the lower frame assembly 40 into position in the mast frame. The lower frame assembly 40 is preferably positioned directly above a work floor. Connecting the lower frame assembly 40 to the mast using mounts 42 or other removable securing means allows the downforce system 10 to be installed and removed from service rig or other rigs as required. For example, the portable downforce system 10 can be used when required on a service rig and either stowed within the frame of a mast by retracting one or more frame assemblies into the frame of the mast or completely removing the portable downforce system from the service rig. The removed portable downforce system may then be placed on a different service rig for use.

The portable downforce system 10 according to this description may comprise its own power without requiring use of the service rig engine to operate. The downforce system for example may comprise a portable power pack. Power supply lines, such as for example hydraulic supply and return lines may be used to provide power from the portable power pack to the actuators of the downforce system. Additionally or alternatively, the portable downforce system may be connected to a power supply on the rig. For example, power supply lines such as hydraulic supply and return lines may direct power such as hydraulic fluid, to the downforce system from the rig power supply.

In another embodiment, an intermediate member, such as intermediate frame assembly 30 may be disposed between the upper frame assembly 20 and the lower frame assembly 40. When an intermediate frame assembly is present, the upper frame assembly is retained on top of the intermediate frame assembly and moves with the intermediate frame assembly. For example, the intermediate frame assembly carrying the upper frame assembly may extend in a substantially horizontal direction from the lower frame assembly. The upper frame assembly may then extend in a substantially horizontal direction from the intermediate frame assembly's new position, thereby increasing the extent of the extension of the upper frame assembly from the lower frame assembly as compared to an embodiment lacking the intermediate frame assembly. The extension may be in any suitable direction by any suitable amount. The extension may be, for example, about 72 inches, about 60 inches, about 48 inches, or about 36 inches. The extension may be less than 36 inches. The extension may be more than 72 inches. For example, the intermediate frame assembly may extend up to about 24 inches from the lower frame assembly and the upper frame assembly may extend up to about 24 inches from the intermediate frame assembly, thereby allowing the upper frame assembly to extend up to about 48 inches from the lower frame assembly. In an embodiment disclosed, the extension may be single scoping, dual scoping, triple scoping, quad scoping etc. One or more of the extension members/components may at least partially nest when retracted. The extension may be provided by any suitable means, and/or a combination of suitable means. In an embodiment disclosed the extension and/or retraction may be provided by one or more of a linear actuator, e.g. hydraulic cylinder (see above), a jack, a ratchet, a winch, gravity, a ball/screw system, a belt or cable or chain or track system, and/or a rack and pinion system (see FIGS. 10-11) as examples only.

The upper, intermediate and lower frame assemblies may be moveably connected to one another, as previously described, by one or more of hydraulic cylinders 46, telescoping rail and roller system 48, and other mechanism configured to slidably move the assemblies relative to one another in the substantially horizontal direction. In an example comprising an extension of about 48 inches between the lower frame assembly and the upper frame assembly, two pairs of 24 inch stroke hydraulic cylinders and 2-stage telescoping rail and roller system are used, where a first pair of each is disposed between the lower frame and the intermediate assembly and a second pair of each is disposed between the intermediate frame assembly and the upper frame assembly. Sequence valves may be used to automatically control the stages and movement of the frame assemblies relative to one another. Horizontal extension stops may be manually set with nuts on a threaded rod of the extension system such that the slip assembly stops above the well center. Other manual or automatic stop means may be used to stop movement of the frame assemblies such as to align the slip assembly with the well center. The extension may take any suitable amount of time. In an example, the extension of the intermediate frame assembly and the upper frame assembly may take about 3 seconds to about 10 seconds, for example about 4 seconds to about 7 seconds, or about 5 seconds, to reach full extension. The retraction may take any suitable amount of time. In an example, the retraction of the intermediate frame assembly and the upper frame assembly may take about 3 seconds to about 10 seconds, for example about 4 seconds to about 7 seconds, or about 5 seconds, to completely retract to the starting position, such as to completely retract to a stowed position within or partially within a mast frame. In an embodiment disclosed the extension and/or retraction may each take up to about 45 seconds, up to about 30 seconds, up to about 15 seconds. The extension and/or retraction may each take more than 45 seconds.

Figure 6:
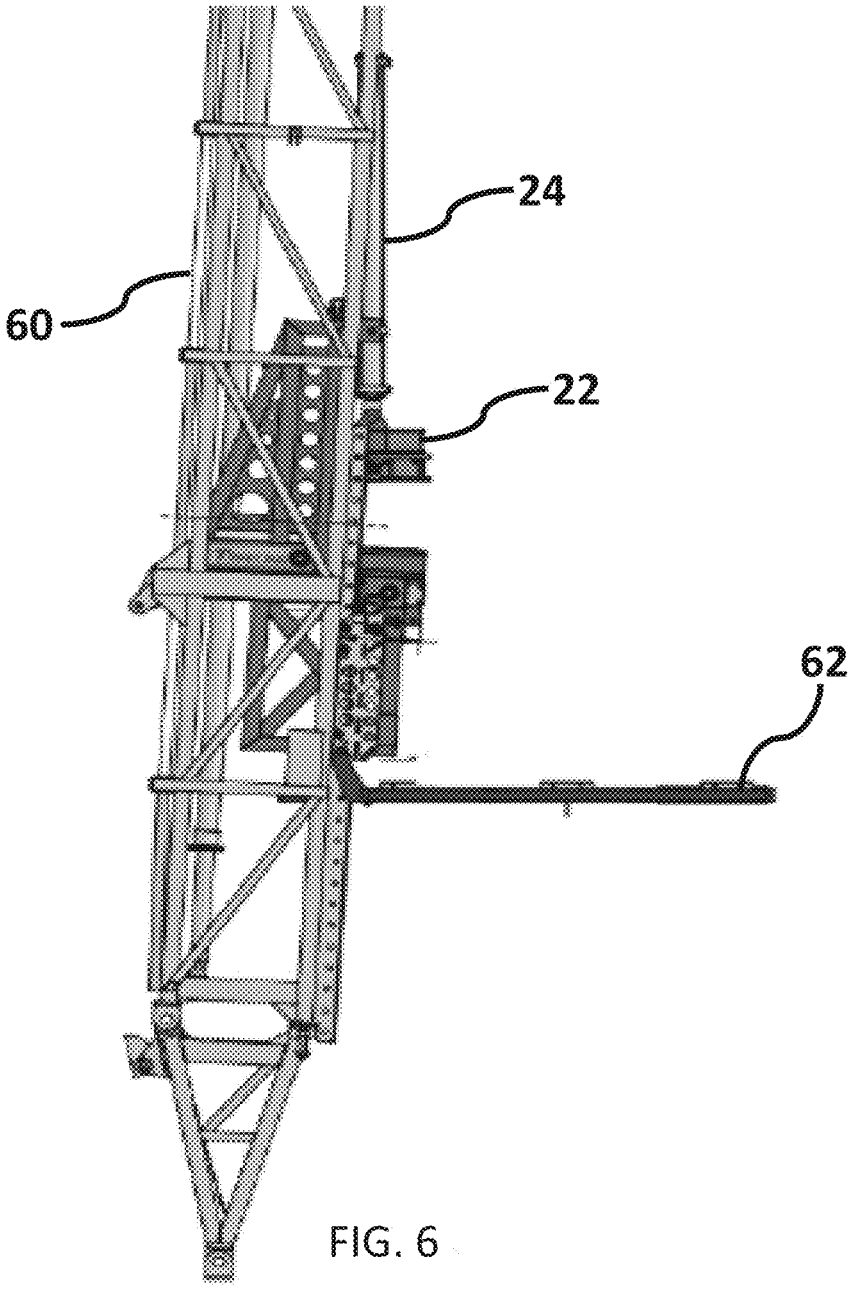
FIG. 6 illustrates a perspective view of the portable downforce system according to embodiments of the present description where the portable downforce system is retracted into a service rig mast.
Figure 7:
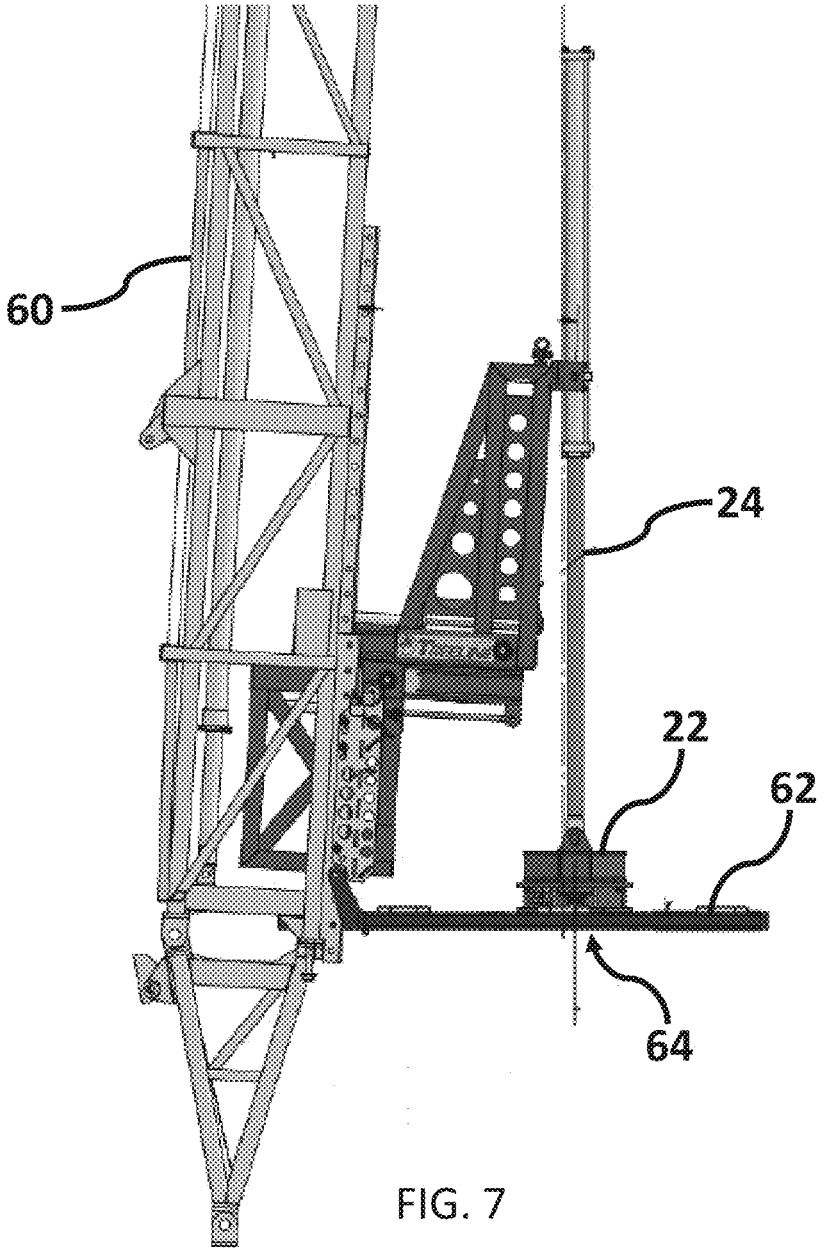
FIG. 7 illustrates a perspective view of the portable downforce system according to embodiments of the present description where the portable downforce system is extended from a service rig mast.
Figure 8:
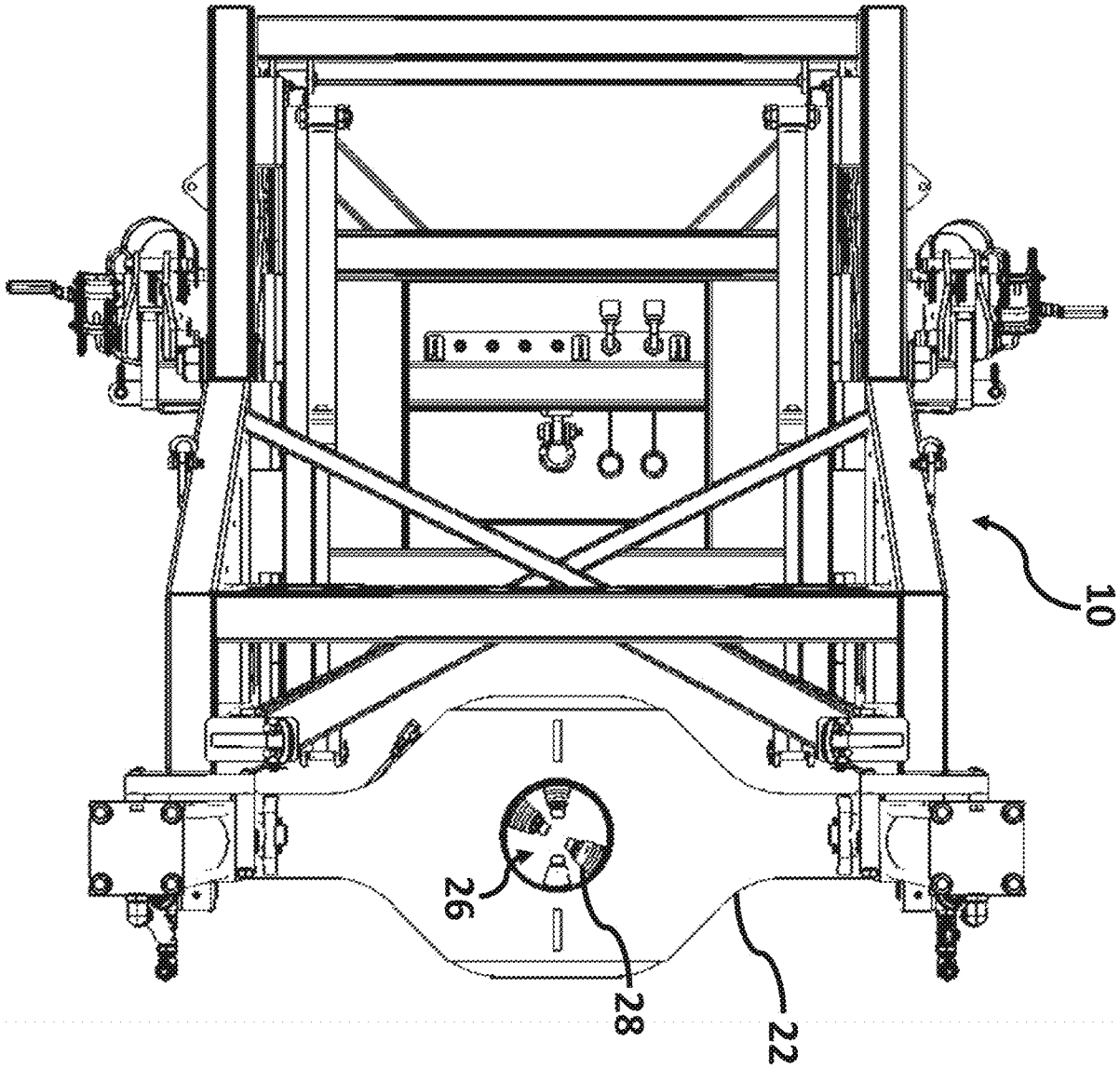
FIG. 8 illustrates a top view of the portable downforce system according to embodiments of the present description.
Figure 9:
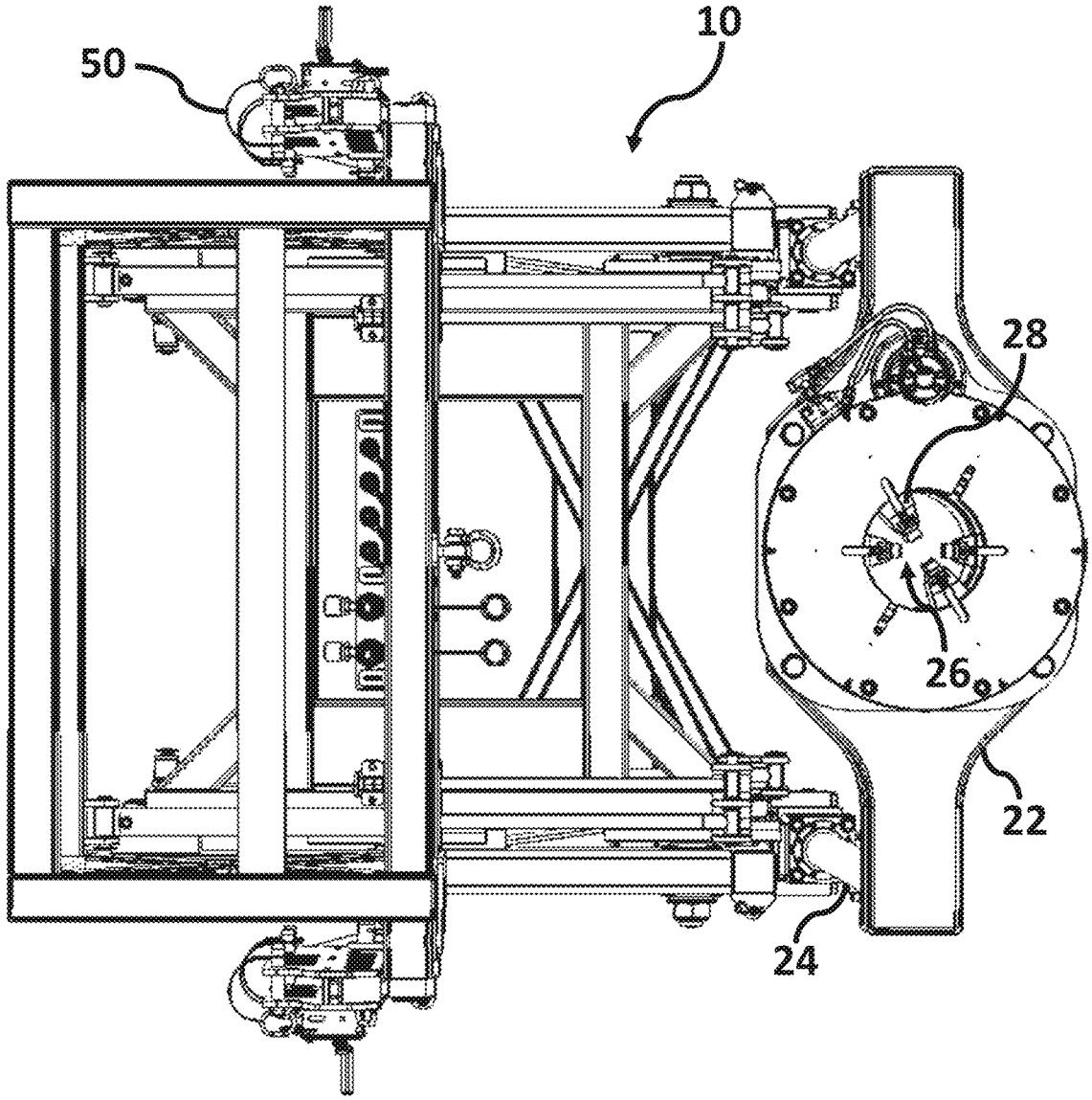
FIG. 9 illustrates a bottom view of a portable downforce system according to embodiments of the present description.

FIGS. 6 and 7 illustrate perspective views of the portable downforce system wherein the portable downforce system is retracted into a service rig mast and wherein the portable downforce system is extended from a service rig mast, respectively. FIGS. 8 and 9 show respective top and bottom views of the portable downforce system 10. As seen in these figures, the slip assembly may be connected to a pair of linear actuators, for example, hydraulic cylinders secured to the upper frame assembly. Actuation of the hydraulic cylinders 24, using hydraulic pressure supplied from the hydraulic supply lines 50, allows the slip assembly 22 to travel vertically (up and down in relation to the direction of gravity, or into and out of the page as illustrated). In an example, the hydraulic cylinders 24 may have a vertical downforce stroke of about 84 inches, for example using 5 inch bore by 3.5 inch rod hydraulic cylinders. The stroke may be any suitable stroke. The stroke may be less than about 84 inches. The stroke may be more than about 84 inches. The stroke may be about 96 inches. The stroke may be about 108 inches. The stroke may be about 132 inches. The stroke may be about 144 inches. The stroke may be more than about 144 inches. The extension and/or retraction time may be any suitable amount of time. In an example where the slip assembly is unloaded, the time for complete extension or retraction may be about 3 seconds to about 10 seconds for example about 5 seconds to about 8 seconds, or about 7 seconds. When the slip assembly is loaded and pushing maximum force, the complete extension or retraction time is about 15 seconds to about 30 seconds, for example about 18 seconds to about 24 seconds, or about 21 seconds. A maximum vertical downforce may be for example about 15,000 daN, but the maximum force may be reduced manually by an operator by for example reducing the available hydraulic pressure, or automatically. In addition, trunnion mounted cylinders (without guide bars) may be used to provide vertical movement in the direction of gravity, independent of mast lean angle.

In an embodiment of the portable downforce system according to the present description, the slip assembly defines an opening, for example a hole or aperture, suitable for accepting any suitable wellbore tubular, for example 8⅝ inch tubulars with 9⅝ inch outside diameter couplings and/or smaller wellbore tubulars, for example an about 1 inch, about 1.6 inch or about 2 inch guidestring. The slip body comprises for example an opening 26 of 10⅛ inches in diameter. Conventional slip assemblies are configured to engage wellbore tubulars with a maximum diameter of 7 inches. The slip body comprising a larger diameter hole 28 allows the portable downforce system 10 to handle larger tubing sizes. Adjustable slip grips 28 may be positioned in the hole 26 to grip tubulars of varying sizes.

The portable downforce system may be installed and uninstalled as desired during completion services on an oil or gas well. In operation, a service rig may be erected proximate or adjacent to a wellhead. The service rig comprises a mast connected to the service rig that may be for example pivotally connected to the service rig and moveable between a storage position and an erected position. The portable downforce system may be hoisted using wires, cables, winches, pulleys or any other means known in the art to a suitable elevation proximate to the mast. The portable downforce system may comprise mounts that may be pinned to a T-bar of the mast of the service rig, for example above a work floor of the service rig to secure the system onto the mast during use. Manual winches may be used to adjust the placement of the downforce system on the mast. Use of the portable downforce system may comprise extending a portion of the system including a slip assembly away from the mast such that the slip assembly aligns with the center of a wellhead and corresponding well. A wellbore tubular or pipe may then be fed through the slip assembly and clamped or otherwise secured by the slip assembly above the wellhead. Linear actuators, for example hydraulic cylinders, may be used to apply a downforce on to the tubulars by driving the slip assembly and the secured tubular into the wellhead. In some examples, linear actuators may be used to apply an upforce to pull tubulars out of the well. When not in use, the portion of the system extended above the wellhead may be retracted away from the tubular path to allow for other operations to be completed. When operations are completed or the downforce system is no longer needed, the portable downforce system may be uninstalled from the mast of the service rig. The portable downforce system accordingly may be used for multiple operations on multiple service rigs over a short period of time as it can be easily installed and uninstalled as needed. However, in an embodiment disclosed, the downforce system may be connected to a service rig in any suitable manner. The connection may be more permanent, for example welding, or less permanent by bolting. The downforce system may be provided in an integrated configuration, built with or into the mast itself.

Figure 10:
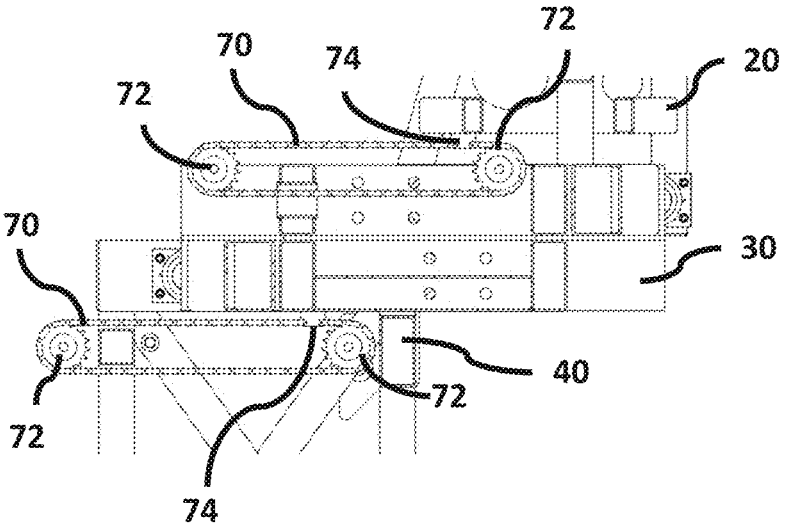
FIG. 10 illustrates a chain system actuator of the present description.
Figure 11:
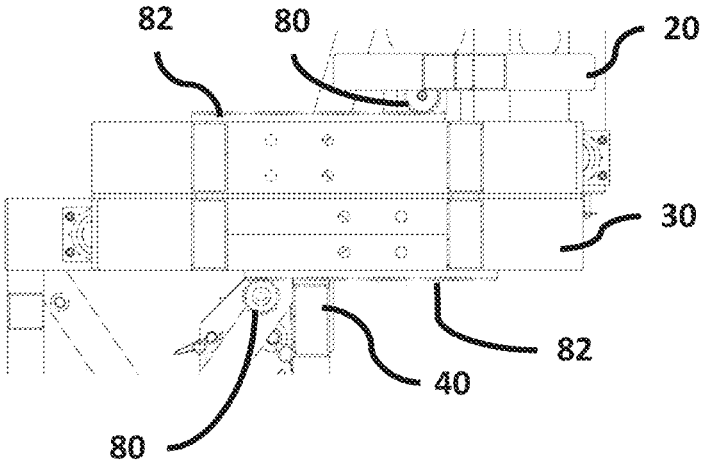
FIG. 11 illustrates rack and pinion actuator of the present description.

FIG. 10 illustrates an example of a chain system actuator and FIG. 11 illustrates an example of a rack and pinion actuator, both rotary to linear motion mechanisms suitable for use as an actuator in the presently disclosed downforce system. In an embodiment disclosed, such actuators may be used instead of, a variant of and/or in combination with another actuator, for example the hydraulic cylinders 46 (see FIG. 4).

Referring to FIG. 10, an endless member, for example a chain 70 extends around and between two or more wheels, for example sprockets 72, 72, and a carriage 74 extends between the chain 70 and a relative movement member, for example intermediate frame assembly 30 and/or upper frame assembly 20. Movement of the chain 70, for example by rotating at least one of the sprockets 72 causes relative linear motion, for example between the lower frame assembly 40 and the intermediate frame assembly 30 and/or between the intermediate frame assembly 30 and the upper frame assembly 20.

Referring to FIG. 11, a gear, for example a pinion 80 operatively connects with a mating rack 82. Rotating the pinion 80 causes relative linear motion between for example between the lower frame assembly 40 and the intermediate frame assembly 30 and/or between the intermediate frame assembly 30 and the upper frame assembly 20.

Figure 12:
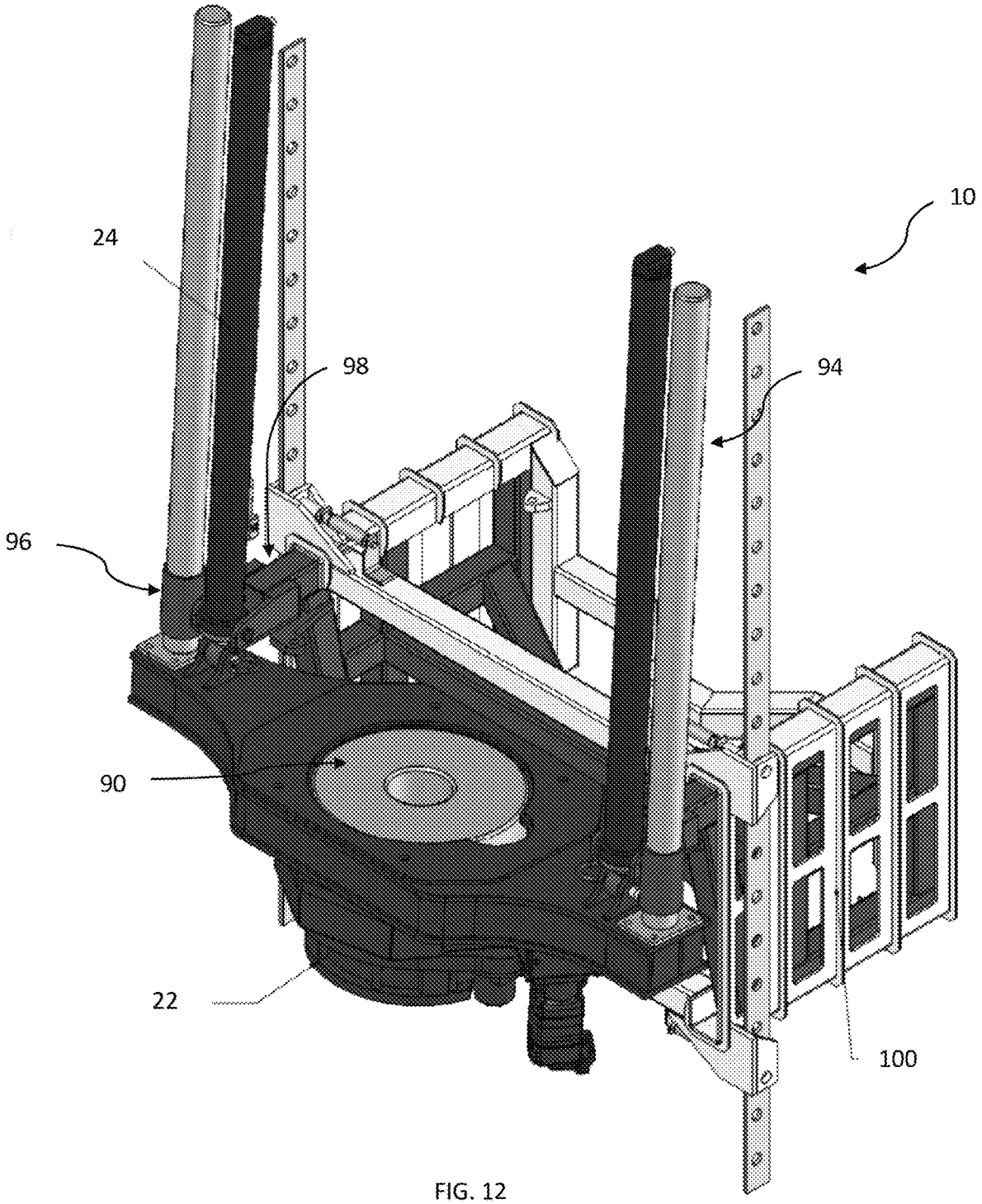
FIG. 12 illustrates a perspective view of a portable downforce system according to embodiments of the present description.
Figure 13:
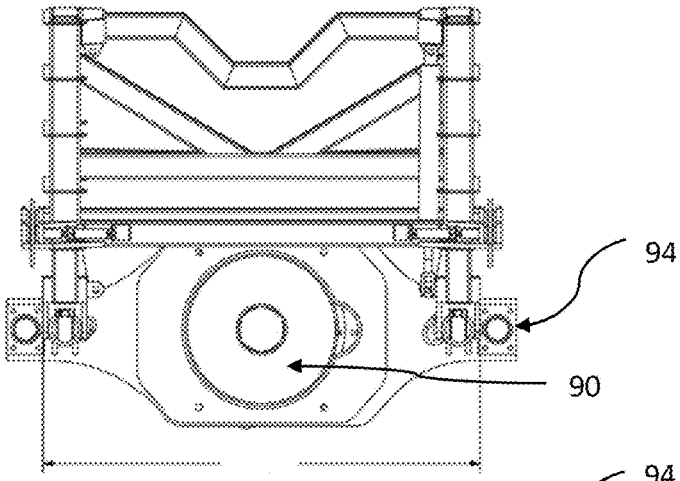
FIG. 13 illustrates a top view of the portable downforce system of FIG. 12.
Figure 14:
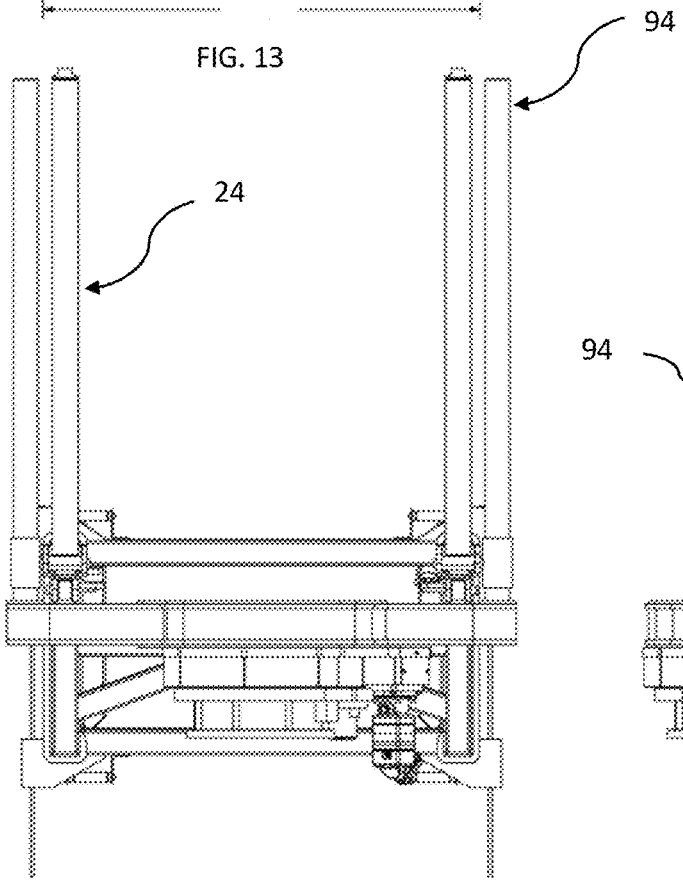
FIG. 14 illustrates a front view of the portable downforce system of FIG. 12.
Figure 15:
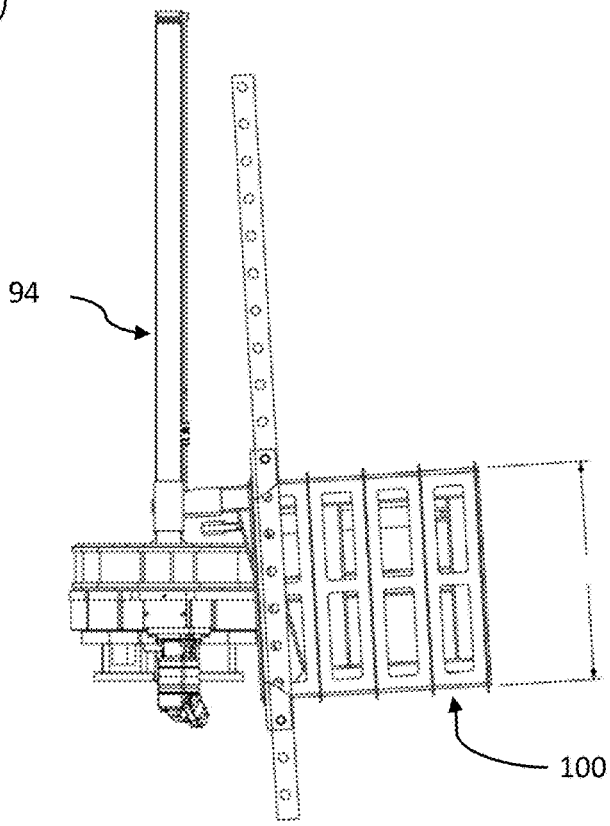
FIG. 15 illustrates a side view of the portable downforce system of FIG. 12.

FIG. 12 illustrates a portable downforce system 10 with slip assembly 22 including an ability to turn, for example a rotary table 90. This, for example, allows a tubular/string held within slip assembly 22 to rotate relative to the rig/mast frame 60. Rotary table 90 may be passive, in that it freely rotates as needed in either direction, it may be restricted from rotating in one direction and/or the other, it may be driven (rotary table drive) in one direction and/or the other, or it may be rotationally locked in place. The available options may include one or more of freely rotate, clockwise rotation, anticlockwise rotation, clockwise drive, anticlockwise drive or locked. In an embodiment disclosed, the option(s) may be selectable by the user.

To counter torsional moments, slip assembly 22 may include anti-torsion attachments directly or indirectly to the mast frame 60. Referring to FIG. 12, the anti-torsion attachments may include guide members 94 extending from the slip assembly 22 which functionally mate with guide members 96, and guide members 96 are attached directly or indirectly the mast frame 60. As illustrated, for example, guide members 94 may be a tubular member and guide members 96 may be hollow cylinder, such that slip assembly 22 with guide members 94 may be moved upward and/or downward, while guide members 96 do not and therefore regardless of the height of the slip assembly 22, the guide members 94/96 provide anti-torsion forces between the slip assembly 22 and the mast frame 60. The guide members 96 may, for example be mounted on a member that is extendable from/into the mast frame 60, for example a frame 98 in a track 100. FIGS. 13-19 provide additional views.

Figure 16:
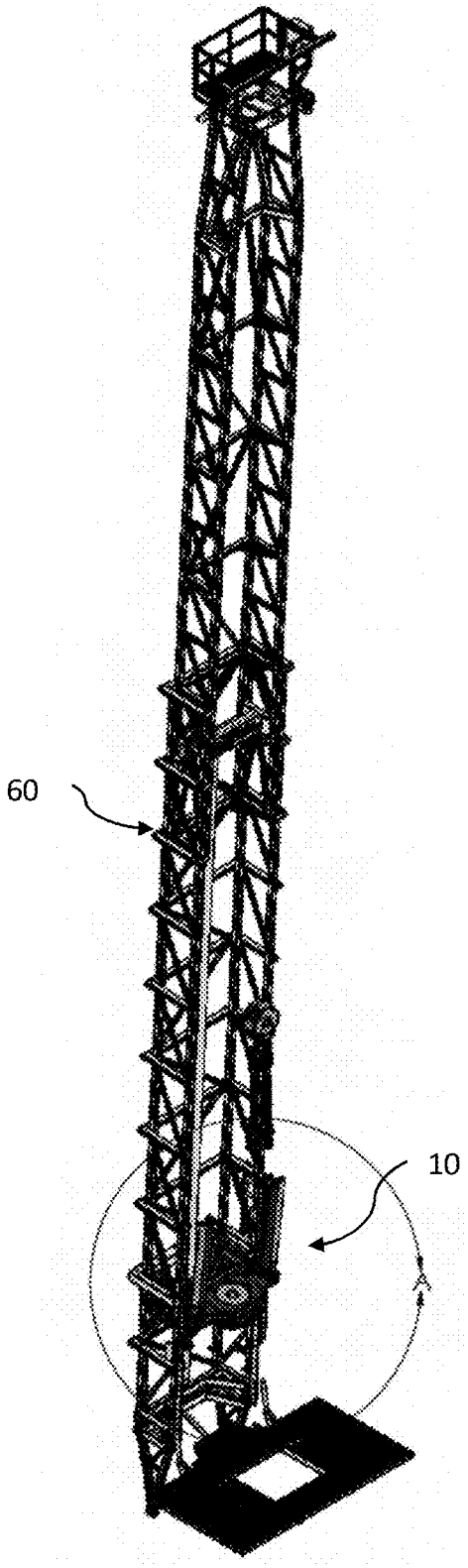
FIG. 16 illustrates a further perspective view of the portable downforce system of FIG. 12.
Figure 17:
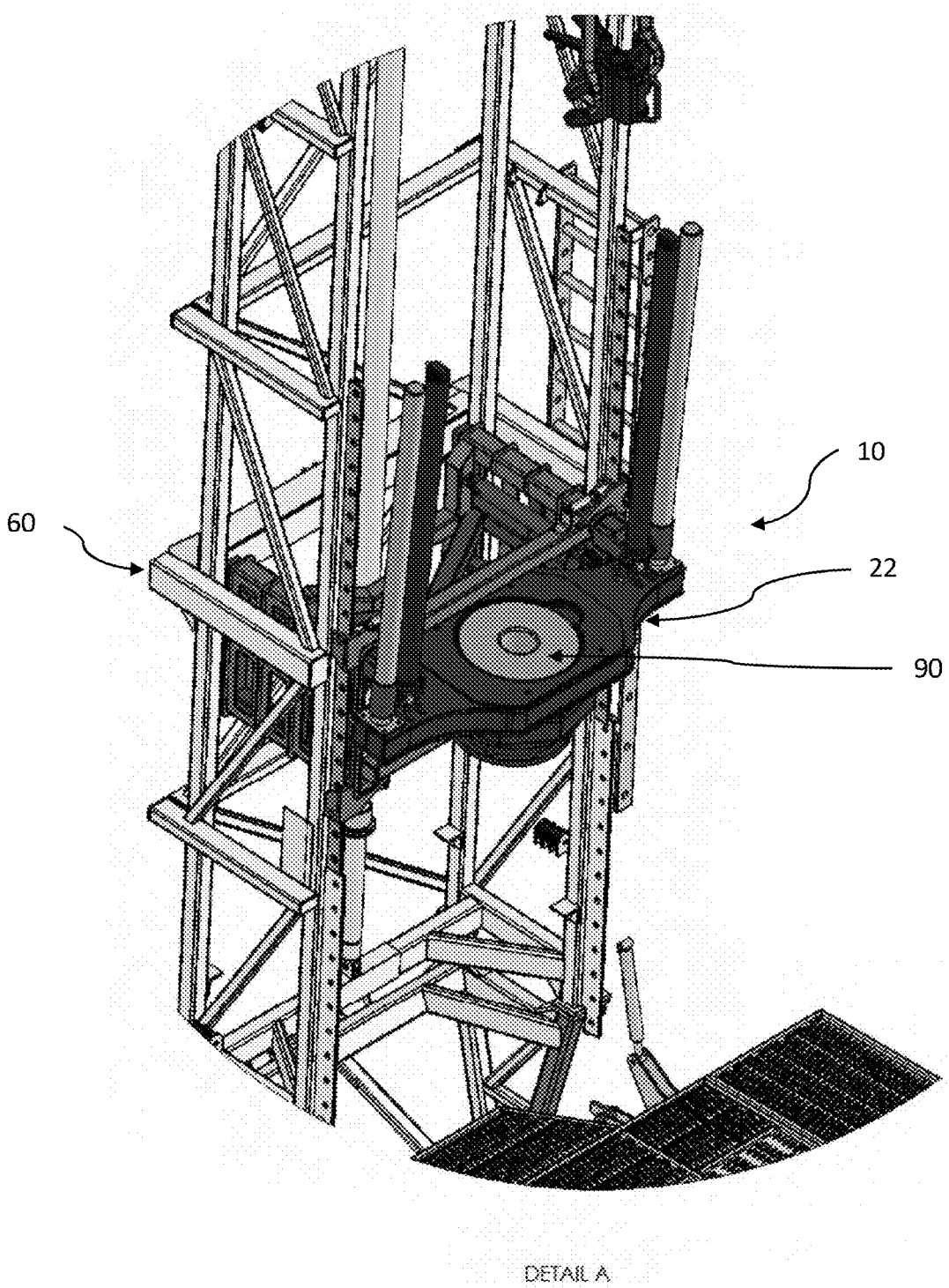
FIG. 17 illustrates an enlarged detail "A" of FIG. 16.
Figure 18:
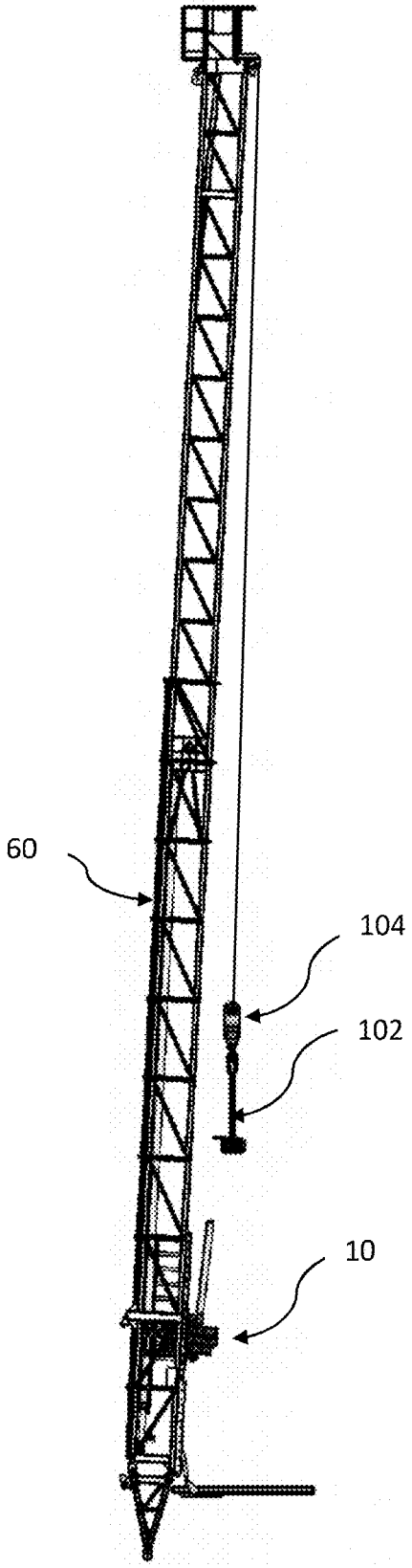
FIG. 18 illustrates a side view of the portable downforce system of FIG. 16.
Figure 19:
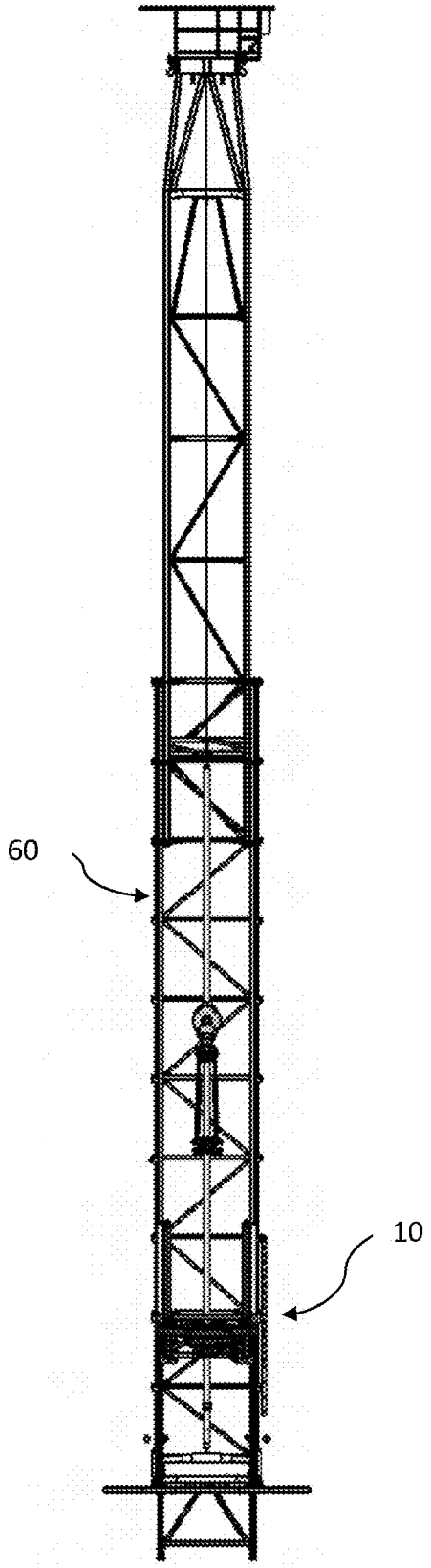
FIG. 19 illustrates a front view of the portable downforce system of FIG. 16.

Referring to FIGS. 16 and 18-19, a travelling block/hook/slips 102 is shown along with a swivel 104. In an embodiment, the portable downforce system 10 and/or the rig may include a drive above the downforce system 10, for example a top drive. In an embodiment disclosed, a rotary table 90 or a top drive or both may be provided. In an embodiment disclosed, the swivel 104 is powered.

The operation of the various actuators, may be controlled by an operator control station (not shown) which allows the operator to selectively activate the various actuators to operate the downforce system.

In a case where the downforce system utilizes one or more hydraulic cylinder, a hydraulic supply may be obtained from the associated rig and/or a separate hydraulic power unit may be provided.

Embodiments disclosed may include any combination of the systems and methods shown in the following numbered paragraphs. This is not to be considered a complete listing of all possible embodiments, as any number of variations can be envisioned from the present disclosure.

Embodiment 1. A portable downforce system comprising, a first frame assembly coupled to a slip assembly for engaging wellbore tubulars, a base member connected to the first frame assembly, and an actuator configured to extend and/or retract the first frame assembly between a first position and a second position, wherein the second position is laterally displaced from the first position along a path formed by extension of the actuator, and wherein the base member is connected to a mast of a service rig.

Embodiment 2. The portable downforce system of Embodiment 1 wherein the first position is a retracted position away from a tubular path into a wellbore and the second position is an extended position aligned with the tubular path into the wellbore.

Embodiment 3. The portable downforce system of Embodiment 2 wherein the first frame assembly extends in a generally horizontal direction orthogonal to the wellbore.

Embodiment 4. The portable downforce system of any one of Embodiments 1 to 3 wherein the slip assembly defines an opening for accepting tubulars up to about 9 inches in diameter with couplings up to about 10 inches in diameter.

Embodiment 5. The portable downforce system of any one of Embodiments 1 to 4, wherein the actuator is one or more of a linear actuator, a hydraulic cylinder, a jack, a ratchet, a winch, a gravity actuator, a ball/screw system, a cable system and/or a rack and pinion system.

Embodiment 6. The portable downforce system of any one of Embodiments 1 to 5 wherein the slip assembly is connected to at least two linear actuators connected to the first frame assembly.

Embodiment 7. The portable downforce system of Embodiment 6 wherein the linear actuators are hydraulic cylinders.

Embodiment 8. The portable downforce system of any one of Embodiments 1 to 6 further comprising an intermediate member between the first frame assembly and the base member.

Embodiment 9. The portable downforce system of Embodiment 8 wherein the linear actuators comprise a first set of linear actuators for displacing the intermediate member from the base member and a second set of linear actuators for displacing the first frame assembly from the intermediate member.

Embodiment 10. The portable downforce system of any one of Embodiments 1 to 9 wherein the base member is securable to a mast of the service rig.

Embodiment 11. The portable downforce system of Embodiment 10 wherein the base member is securable to a T-bar of a mast frame of the mast.

Embodiment 12. The portable downforce system of Embodiment 11 wherein the base member is connected to discrete mounts pinned to the T-bar of the mast frame.

Embodiment 13. The portable downforce system of Embodiment 11 or 12 wherein the first frame assembly is substantially within the mast frame when in the first position.

Embodiment 14. The portable downforce system of any one of Embodiments 11 to 13 wherein the base member comprises a winch for adjusting a position of the base member in the mast frame.

Embodiment 15. The portable downforce system of any one of Embodiments 1 to 14 wherein a power supply separate from the service rig is provided to the portable downforce system.

Embodiment 16. The portable downforce system of any one of Embodiments 1 to 15 wherein the slip assembly comprises a rotary table.

Embodiment 17. The portable downforce system of Embodiment 16, wherein the rotary table is operable in one or more operation mode comprising freely rotatable, clockwise rotation, anticlockwise rotation, clockwise drive, anticlockwise drive and/or locked.

Embodiment 18. The portable downforce system of Embodiment 17, wherein the one or more operation mode is selectively set by a user.

Embodiment 19. A method for moving wellbore tubulars into or out of a wellhead, the method comprising, positioning a travelling slip assembly in line with a center of the wellhead, feeding a tubular through the travelling slip assembly; applying a downforce or an upforce using the travelling slip assembly to push the tubular into or pull the tubular out of the wellhead; and retracting the travelling slip assembly so that it is no longer in line with the center of the wellhead when not in use.

Embodiment 20. The method of Embodiment 19 wherein the positioning or the retracting or both comprise lateral movement of the travelling slip assembly.

Embodiment 21. The method of Embodiment 19 wherein the positioning or the retracting or both consist of lateral movement of the travelling slip assembly.

Embodiment 22. The method of any one of Embodiments 19 to 21 further comprising installing a portable downforce system comprising the travelling slip assembly to a mast of a service rig before positioning the tubular in line with the center of the wellhead.

Embodiment 23. The method of Embodiment 22 further comprising uninstalling the portable downforce system when not in use.

Embodiment 24. The method of any one of Embodiments 19 to 23 wherein the wellhead is associated with a wellbore having a wellbore trajectory, having a string of wellbore tubulars therein, wherein a resistance force resisting movement of the string of wellbore tubulars is substantially equal to or exceeds the force of gravity urging movement of the string of tubulars into the wellbore.

Embodiment 25. The method of Embodiment 24 wherein the wellbore trajectory comprises a shallow horizontal well, having a relatively shorter substantially vertical section and a relatively longer horizontal or deviated section.

Embodiment 26. The method of any one of Embodiments 19 to 25 wherein the wellhead is associated with a steam assisted gravity drainage (SAGD) well.

Embodiment 27. The method of any one of Embodiments 19 to 26 wherein a pressure at the wellhead has been substantially equalized by a kill fluid such that the pressure is substantially reduced to or is substantially zero.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims.

The invention claimed is:

1. A portable downforce system comprising, a first frame assembly coupled to a slip assembly for engaging wellbore tubulars, a base member connected to the first frame assembly, and an actuator configured to extend and/or retract the first frame assembly between a first position and a second position, wherein the second position is laterally displaced from the first position along a path formed by extension of the actuator, and wherein the base member is connected to a mast of a service rig, wherein the first position is a retracted position away from a tubular path into a wellbore and the second position is an extended position aligned with the tubular path into the wellbore, and wherein the first frame assembly extends in a generally horizontal direction orthogonal to the wellbore.

2. The portable downforce system of claim 1 wherein the actuator is one or more of a linear actuator, a hydraulic cylinder, a jack, a ratchet, a winch, a gravity actuator, a ball/screw system, a cable system and/or a rack and pinion system.

3. The portable downforce system of claim 1 wherein the slip assembly is connected to at least two linear actuators connected to the first frame assembly.

4. The portable downforce system of claim 3 wherein the linear actuators are hydraulic cylinders.

5. The portable downforce system of claim 1 further comprising an intermediate member between the first frame assembly and the base member.

6. The portable downforce system of claim 5 wherein the linear actuators comprise a first set of linear actuators for displacing the intermediate member from the base member and a second set of linear actuators for displacing the first frame assembly from the intermediate member.

7. The portable downforce system of claim 1 wherein the base member is securable to a T-bar of a mast frame of the mast.

8. The portable downforce system of claim 7 wherein the base member is connected to discrete mounts pinned to the T-bar of the mast frame.

9. The portable downforce system of claim 7 wherein the first frame assembly is substantially within the mast frame when in the first position.

10. The portable downforce system of claim 1 wherein a power supply separate from the service rig is provided to the portable downforce system.

11. A portable downforce system, comprising a first frame assembly coupled to a slip assembly for engaging wellbore tubulars, a base member connected to the first frame assembly, and an actuator configured to extend and/or retract the first frame assembly between a first position and a second position, wherein the second position is laterally displaced from the first position along a path formed by extension of the actuator, and wherein the base member is connected to a mast of a service rig, wherein the slip assembly comprises a rotary table.

12. The portable downforce system of claim 11 wherein the rotary table is operable in one or more operation mode comprising freely rotatable, clockwise rotation, anticlockwise rotation, clockwise drive, anticlockwise drive and/or locked.

13. The portable downforce system of claim 12 wherein the one or more operation mode is selectively set by a user.

* * * * *